US006350186B1

(12) United States Patent
Tsuchiya

(10) Patent No.: US 6,350,186 B1
(45) Date of Patent: Feb. 26, 2002

(54) APPARATUS AND METHOD FOR CHEMICAL MECHANICAL POLISHING

(75) Inventor: Yasuaki Tsuchiya, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/444,358

(22) Filed: Nov. 18, 1999

(30) Foreign Application Priority Data

Nov. 18, 1998 (JP) ..... 10-328693

(51) Int. Cl.[7] ..... B24B 7/00
(52) U.S. Cl. ..... 451/259; 451/41; 451/288
(58) Field of Search ..... 451/259, 41, 42, 451/285, 287, 288, 397, 398

(56) References Cited

U.S. PATENT DOCUMENTS

| | | | | | |
|---|---|---|---|---|---|
| 5,558,563 | A | * | 9/1996 | Cote et al. | 451/41 |
| 5,653,622 | A | * | 8/1997 | Drill et al. | 451/5 |
| 5,672,095 | A | * | 9/1997 | Morimoto et al. | 451/41 |
| 5,681,212 | A | * | 10/1997 | Hayakawa et al. | 451/288 |
| 5,735,731 | A | * | 4/1998 | Lee | 451/143 |
| 5,904,609 | A | * | 5/1999 | Fukuroda et al. | 451/8 |
| 5,908,530 | A | * | 6/1999 | Hoshizaki et al. | 156/345 |
| 5,931,719 | A | * | 8/1999 | Nagahara et al. | 451/41 |
| 5,938,884 | A | * | 8/1999 | Hoshizaki et al. | 156/345 |
| 5,944,589 | A | * | 8/1999 | Nakajima | 451/285 |
| 6,033,987 | A | * | 3/2000 | Lin et al. | 438/692 |
| 6,077,155 | A | * | 6/2000 | Hayakawa et al. | 451/288 |
| 6,126,514 | A | * | 10/2000 | Muroyama | 451/36 |

FOREIGN PATENT DOCUMENTS

| | | |
|---|---|---|
| JP | 1-306172 | 12/1989 |
| JP | 6-196456 | 7/1994 |
| JP | 7-60637 | 3/1995 |
| JP | 7-88758 | 4/1995 |
| JP | 7-130686 | 5/1995 |
| JP | 9-225820 | 9/1997 |
| JP | 9-260316 | 10/1997 |
| JP | 10-180618 | 7/1998 |

OTHER PUBLICATIONS

English Abstracts for JP Application No. 9–225820.
English Abstracts for JP Application No. 7–130686.
English Abstracts for JP Application No. 1–306172.
English Abstracts for JP Application No. 7–88758.
English Abstract for JP Appication No. 6–196456.
English Abstracts for JP Application No. 7–60637.
English Abstract for JP Application No. 9–260316.
English Abstracts for JP Application No. 10–180618.

* cited by examiner

*Primary Examiner*—Derris H. Banks
*Assistant Examiner*—Hadi Shakeri
(74) *Attorney, Agent, or Firm*—Hutchins, Wheeler & Dittmar

(57) ABSTRACT

When a polishing target film on a wafer is pressed against and contacted with a polishing pad to be subjected to CMP polishing, the wafer is supported by a backing plate through a contact pressure adjusting section. The surface of the adjusting section is worked to have a high region corresponding to a high region of the polished surface of the polishing target film and to have a low region corresponding to a low region of the polished surface thereof in order to adjust the contact pressure for contacting the polished surface with the polishing pad in accordance with the difference in the height of the polished surface. Accordingly, the polished surface of the polishing target film can uniformly planarized.

20 Claims, 5 Drawing Sheets

APPARATUS AND METHOD FOR CHEMICAL MECHANICAL POLISHING

BACKGROUND OF THE INVENTION

1. Field of the Invention

The present invention relates to a chemical mechanical polishing (to be referred to as "CMP" hereinafter) apparatus and a CMP method for pressing a wafer against a polishing pad with the wafer supported by a carrier, rotating the polishing pad to revolve the wafer about the center of the polishing pad relative to the polishing pad, rotating the wafer around its own central axis and thereby allowing the polishing pad to polish the wafer. The present invention particularly relates to a CMP apparatus and a CMP method capable of polishing a film formed on a wafer to be have a quite planarized surface.

2. Description of the Related Art

FIG. 1 shows the outline of a conventional CMP apparatus. A polishing pad 1 is driven to rotate about a central shaft 1*a* of the pad 1 and a backing plate 2 serving as a carrier is provided above the polishing pad 1. A carrier film 3 is bonded to the lower surface of the backing plate 2 and a wafer 4 is attached and fixed onto the lower surface of the backing plate 2 through the carrier film 3.

While the backing plate 2 is driven to rotate to thereby cause the wafer 4 to rotate on its own axis, a polishing target film 5 on the surface of the wafer 4 is pressed against the polishing pad 1, the wafer 4 is relatively revolved about the center of the polishing pad 1 by the rotation of the polishing pad 1 and the polishing target film 5 of the wafer 4 is thereby polished by the polishing pad 1. It is noted that the conventional backing plate 2 has a flat surface.

In the conventional CMP apparatus, however, it has been difficult to planarize the entire surface of the wafer uniformly and accurately. In recent years, planarity of about 30 nm (allowable irregularity) is demanded if the surface of a film, in which an embedded wiring such as damascene wiring is formed, is planarized. If this high planarity is not attained, erosion or recess which is a parameter indicating an depression amount at the time of forming, for example, a damascene wiring grows and the irregularity of wiring resistance thereby increases, then the reliability and acceleration of a circuit formed on the surface of the wafer is adversely affected.

Further, according to the conventional CMP technique, if irregularity exists in the radial direction of the wafer and the film thickness distribution of the polishing target film is concentric, they can be planarized. However, if irregularity exists in the circumferential direction of the wafer, they cannot be planarized by means of CMP.

Moreover, if a polishing apparatus has its own particularity as to the planarity of the polished surface of the wafer, the conventional CMP technique cannot eliminate the particularity.

Meanwhile, there is disclosed a method of adjusting the polishing pad of a CMP apparatus by dividing the pad surface of the polishing pad according to the film thickness distribution of the device surface of a semiconductor substrate and adjusting the surface roughness of the pad surface to have different roughnesses using a plurality of grindstones having different hardnesses (Japanese Patent Application Laid-Open No. Hei 10-180618). This is, however, a method for adjusting the surface roughness of the polishing pad and not for directly planarizing the wafer surface. The method is, therefore, not enough to apply to the high accuracy planarization of a wafer surface.

SUMMARY OF THE INVENTION

It is, therefore, an object of the present invention to provide a CMP apparatus and a CMP method capable of accurately, uniformly planarizing the polished surface of a polishing target film formed on a wafer throughout the wafer and capable of accurately planarizing the polishing target surface throughout the wafer even if irregularity exists in the circumferential direction of the wafer or a polishing apparatus has its own peculiarity in polishing.

A chemical mechanical polishing apparatus according to the present invention comprises a polishing pad; a carrier supporting a wafer as a polishing target; driving means for causing the carrier to rotate on its own central axis and revolving the carrier about a center of the polishing pad; and pressing means for pressing the wafer against the polishing pad through the carrier. To adjust contact pressure for contacting a polished surface of a polishing target film on the wafer with the polishing pad according to heights of the polished surface, it is preferable that a surface of the carrier is worked to have a high region corresponding to a high region of the polished surface of the polishing target film and to have a low region corresponding to a low region of the polished surface. Also, a film may be provided on a surface of the carrier, said film having a thick region corresponding to a high region of the polished surface of the polishing target film and having a thin region corresponding to a low region of the polished surface. A film may be provided on a surface of the carrier, said film having a hard region corresponding to a high region of the polished surface of the polishing target film and having a soft region corresponding to a low region of the polished surface. In this case, a difference in the height of the surface of the carrier is preferably 100 to 500 times as large as a difference in the height of the polished surface of the polishing target film. A plurality of pins protruding from a wafer support surface of the carrier and pin height adjusting unit for adjusting protruding heights of the pins may be provided.

Further, another chemical mechanical polishing apparatus according to the present invention comprises a polishing pad; a carrier supporting a wafer as a polishing target; driving unit for causing the carrier to rotate on its own central axis and rotating the carrier about a center of the polishing pad; and pressing unit for pressing the wafer against the polishing pad through the carrier, wherein contact pressure for contacting a polished surface of a polishing target film on the wafer with the polishing pad is adjusted depending on whether a region of the polished surface is polished easily or less easily based on a relationship between the carrier and the polishing pad.

In the above-stated chemical mechanical polishing apparatus, the adjusting means can be an adjusting means having in addition, the carrier is a stainless steel backing plate.

A chemical mechanical polishing method according to the present invention comprises the steps of pressing a wafer as polishing target against a polishing pad while the wafer is supported by a carrier; and rotating the polishing pad to rotate the wafer about a center of the polishing pad and to cause the wafer to rotate on its own central axis, is characterized by comprising the step of adjusting contact pressure for contacting a surface of the wafer with the polishing pad in accordance with heights of a surface of the wafer.

Another chemical mechanical polishing method according to the present invention comprises the steps of pressing a wafer as polishing target against a polishing pad while the wafer is supported by a carrier; and rotating the polishing pad to rotate the wafer about a center of the polishing pad and to cause the wafer to rotate on its own central axis, is characterized by comprising the step of adjusting contact pressure for contacting a polished surface of a polishing target film on the wafer with the polishing pad depending on whether a region of the polishing target surface is polished easily or less easily based on a relationship between the carrier and the polishing pad.

DESCRIPTION OF THE PREFERRED EMBODIMENT

Figure 1:
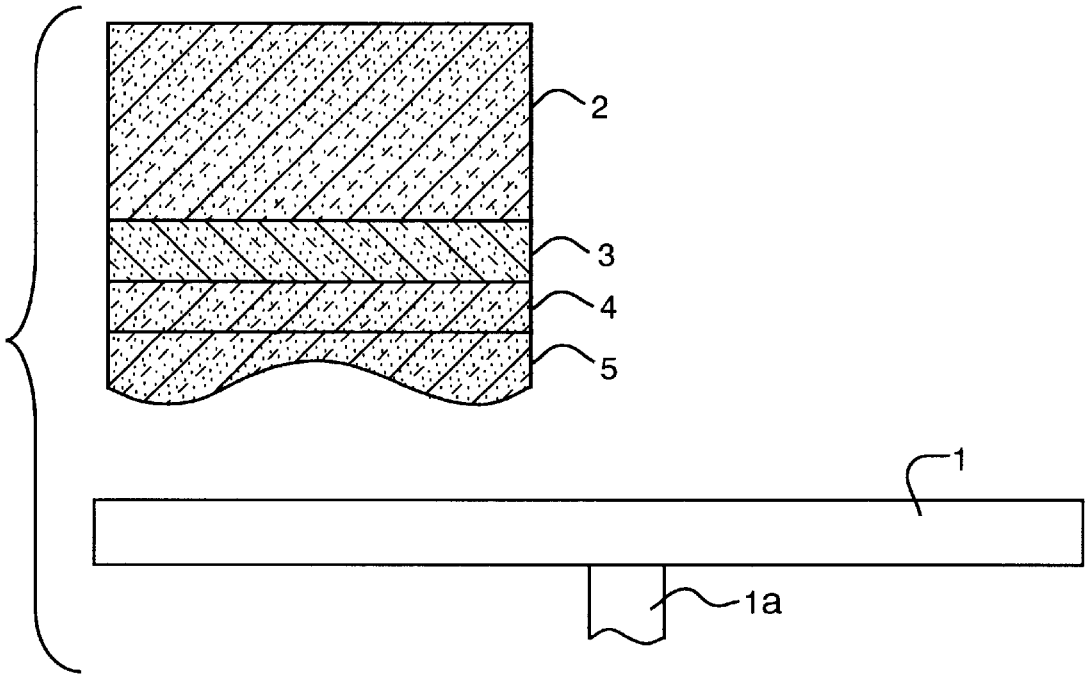
FIG. 1 (PRIOR ART)
FIG. 1 is a typical view showing a conventional CMP apparatus.
Figure 2:
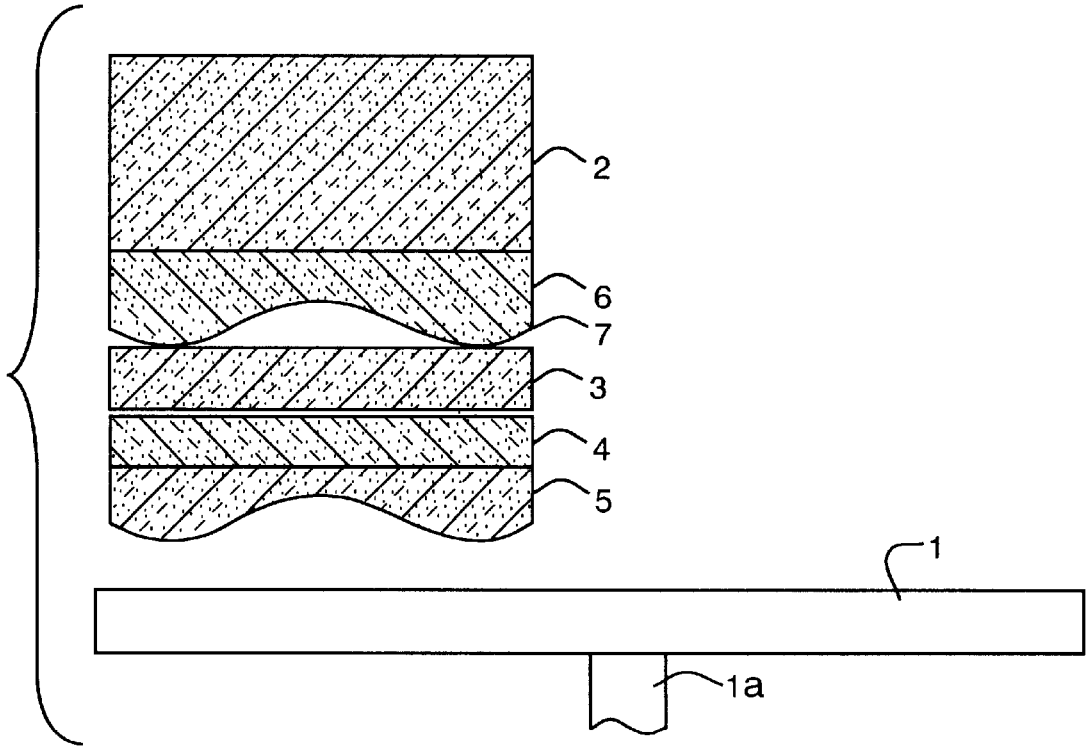
FIG. 2 is a typical view showing a CMP apparatus in one embodiment according to the present invention.

Now, the embodiment of the present invention will be concretely described with reference to the accompanying drawings. FIG. 2 shows a CMP apparatus in the embodiment of the present invention. For example, a contact pressure adjusting section 6 is formed on the surface of a stainless steel backing plate 2. A wafer 4 is bonded and joined to the surface 7 of the adjusting section 6 through a carrier film 3. A polishing target film 5 is formed on the surface of the wafer 4 and the surface of the film 5 has irregularity as shown in FIG. 2.

In this embodiment, the contact pressure adjusting section 6 is provided on the surface of the backing plate 2 and interposed between the backing plate 2 and the wafer 4. The surface of the contact pressure adjustment section 6 has an irregular shape corresponding to that of the polishing target film 5 on the surface of the wafer 4. That is to say, the surface of the adjusting section 6 is formed such that the height of the adjusting section 6 is large in a region in which the surface of the polishing target film 5 is high and small in a region in which the surface of the film 5 is low. The contact pressure adjusting section 6 may be formed by directly working the surface of the backing plate 2 or by working a surface of a different plate and then bonding and fixing the surface worked plate to the surface of the backing plate 2.

Next, the operation of the apparatus in this embodiment constituted as stated above will be described. While the polishing pad 1 is drive to rotate about its central shaft 1*a*, as at step 102, and the backing plate 2 is revolved about the center of the pad 1, the backing plate 2, as at step 104, is pressed against the polishing pad 1, as at step 106. By doing so, the polishing target film 5 on the surface of the wafer 4 is supported by the backing plate 2 through the carrier film 3 is brought into contact with the polishing pad 1 with certain pressure and polished by the pad 1, as at step 108. In this case, the contact pressure adjusting section 6 is provided on the surface of the backing plate 2 and the wafer 4 is pressed toward the polishing pad 1 from the back by this adjusting section 6. Due to this, the wafer 4 is applied with high polishing pressure (contact pressure) at a high portion (crest portion) and applied with low polishing pressure (contact pressure) at a low portion (trough portion). Thus, the portion (convex) of the wafer 4 corresponding to the crest portion of the adjusting section 6 is polished strongly and that (concave) thereof corresponding to the trough portion of the adjusting section 6 is polished weakly. As a result, the polishing target film 5 on the wafer 4 has a uniform thickness throughout the surface of the wafer and irregularity on the surface of the polishing target film 5 is eliminated, whereby a polished surface of quite high planarity can be obtained.

Figure 3A:
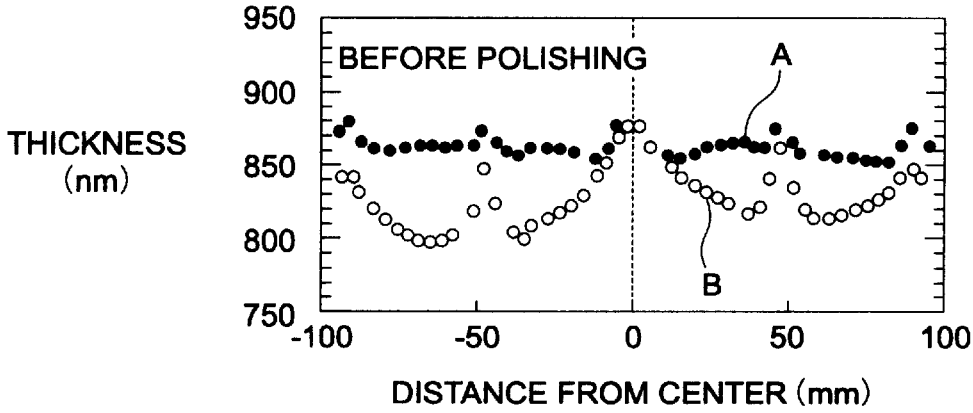
FIGS. 3A to 3C are graphs for describing the peculiarity of the polishing apparatus in polishing apparatus in polishing.
Figure 3B:
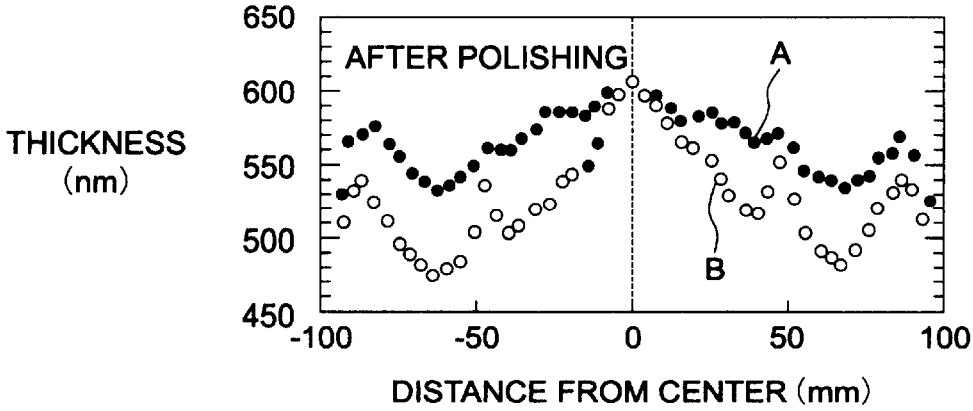
Figure 3C:
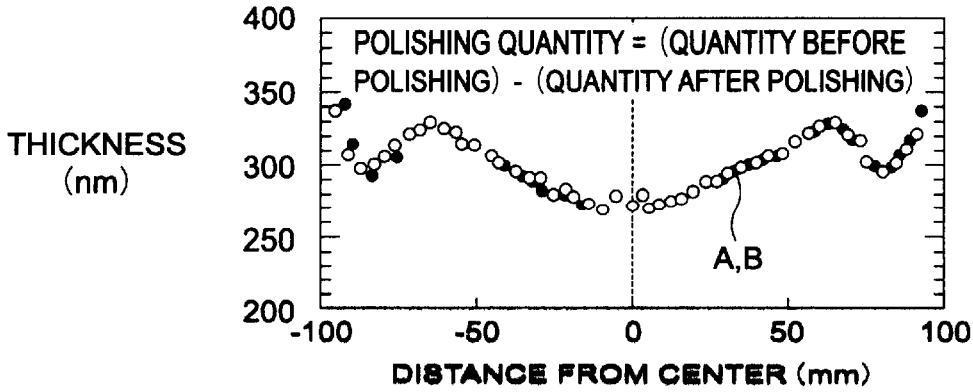

FIGS. 3A to 3C are graphs showing irregularity on the surface of the polishing target film with the horizontal axis indicating the radius of the wafer (in the range of ±100 nm relative to the center 0 of the wafer) and the vertical axis indicating the height of a polished surface (unit: Å). The polishing target film is a tungsten film formed by the CVD method. FIG. 3A shows film planarity before polishing for two types of wafers (films). FIG. 3B shows film planarity after polishing the two types of wafers using a conventional polishing apparatus. FIG. 3C shows the distance obtained by subtracting a film thickness after polishing from a film thickness before polishing. As shown in FIG. 3C, the difference in film thickness between the film before polishing and that after polishing has almost the same pattern for the two types of wafers A and B which differ in film planarity before polishing. Namely, it is seen that if polishing target films of the wafers are polished using the same polishing apparatus, they are polished in a fixed manner irrespectively of the difference in the distribution pattern of the film thickness of the polishing target film on the wafer and the polishing apparatus polishes a target with the magnitude of polishing always having a fixed distribution in the plane of the wafer. This is a polishing peculiarity of the polishing apparatus.

In other words, since the polishing apparatus polishes the polishing target film on the wafer while always having a constant distribution in the plane of the wafer as the magnitude of polishing, an irregular pattern on the surface of the polishing target film before polishing is directly reflected in that of the surface after polishing. For that reason, the conventional polishing apparatus can improve the planarity of a target film on a local scale in terms of the wafer but cannot improve the planarity of the entire surface of the wafer.

Further, if an irregular pattern on the surface of the polishing target film 5 appears radially and a film thickness distribution is concentric, the film 5 can be planarized to some extent depending on the polishing type or by processing the polishing pad. If the irregular pattern on the surface of the polishing target film 5 is not concentric, i.e., it appears in the circumferential direction of the wafer 4, the film 5 cannot be planarized by the conventional CMP technique.

Figure 4:
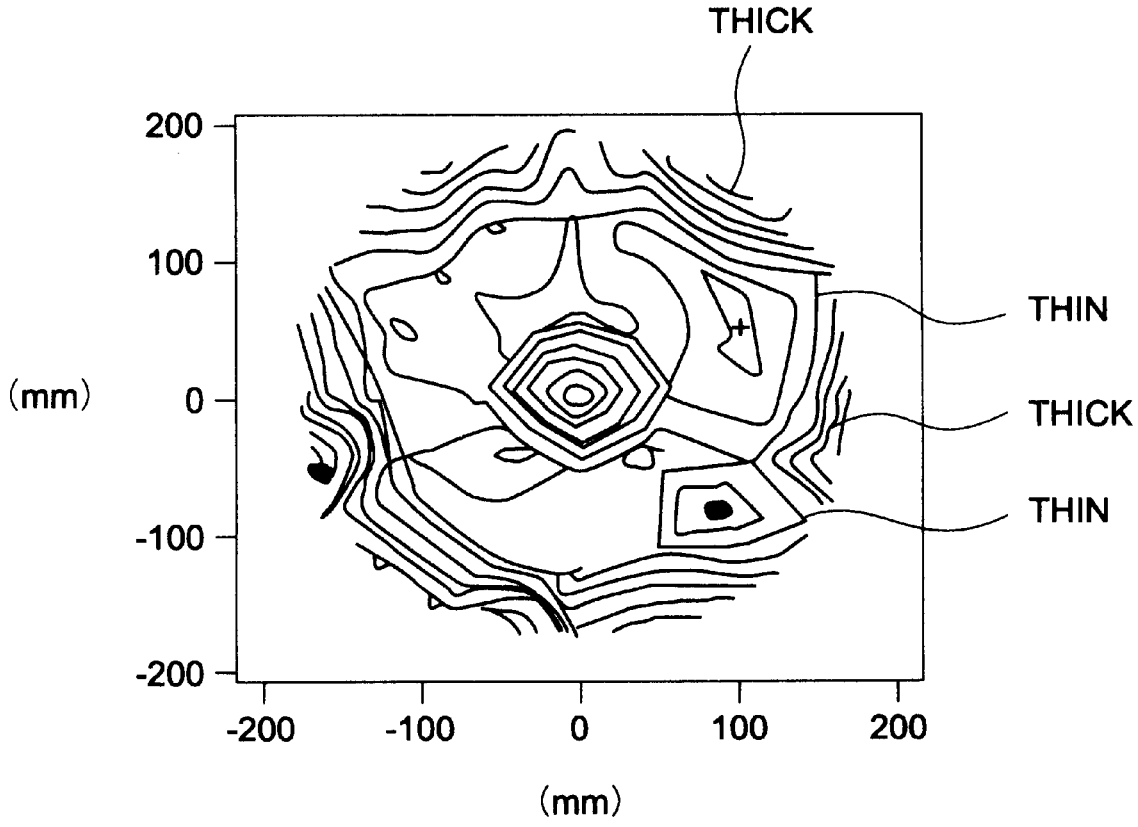
FIG. 4 shows the film thickness distribution of a plated film in the circumferential direction of a wafer.
Figure 5:
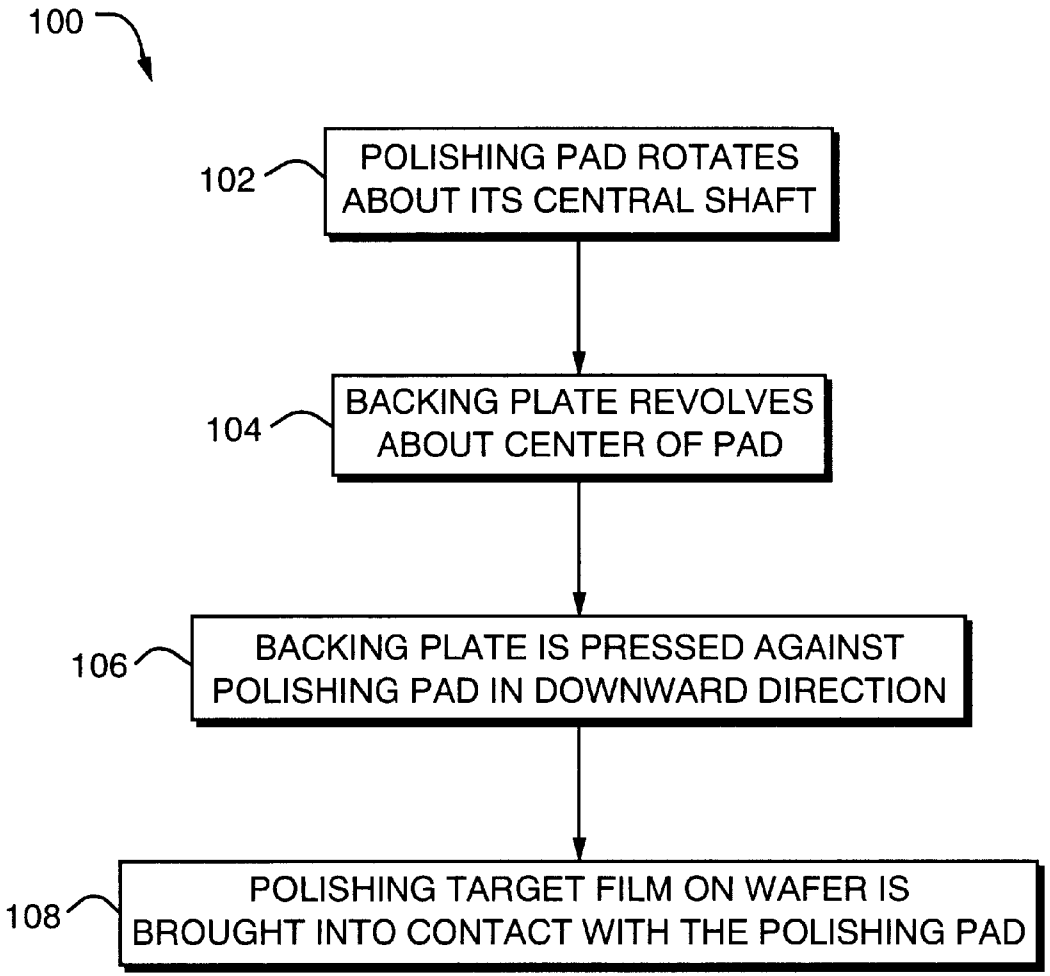

FIG. 4 shows the measurement result of the irregularity of the surface of a copper film if the film is formed on the wafer by electroplating. The copper plated film has a thickness distribution pattern in which a thick portion and a thin portion alternately appear in the circumferential direction of the wafer as indicated by contour lines on the surface of the copper plated film shown in FIGS. 3A to 3C. This is because thick portions of the plated film are generated according to the positions of electrodes within a plating tank. As can be seen, if irregularity appears on a polishing target film in the circumferential direction of the wafer, the conventional polishing apparatus cannot polish the film.

Meanwhile, in this embodiment, the film thickness distribution of the polishing target film 5 in the plane of the wafer is measured. Specifically, if the polishing target film is a metal film, an in-plane film thickness distribution is obtained from the measurement result of the distribution of electric resistance (sheet resistance) in the plane of the wafer by a four-probe method. If the polishing target film is an insulating film such as an oxide film, the in-plane film thickness distribution is obtained from the result of an optical film thickness measurement by a light interference method.

Next, the surface of the backing plate 2 is processed to form a contact pressure adjusting section 6 so that the section 6 may have a surface form having the same two-dimensional film thickness distribution as that. of the polishing target film. In this case, it is assumed that the variation range of the irregularity on the surface of the adjusting section 6 is 100 to 500 times as large as that of the irregularity on the surface of the polishing target film 5 of the wafer 4 and that the range of the irregularity on the surface of the adjusting section 6 corresponds to the increased variation range of the film thickness of the polishing target film 5. For example, if the film thickness distribution range of the polishing target film 5 is 2000 Å (0.2 μm), the irregularity range on the surface of the backing plate 2 is 20 μm.

Thereafter, following ordinary processing procedures, a carrier film 3 is attached to the adjusting section 6. While the orientation of the wafer 4 and that of the adjusting section 6 are matched using, for example, the orientation flat of the wafer 4, the wafer 4 is supported by the adjusting section 6 through the carrier film 3.

While the backing plate 2 is pressed toward the polishing pad 1 and the polishing target film 5 on the surface of the wafer 4 is pressed against the polishing pad 1 with appropriate pressing force, the wafer 4 is caused to rotate on its own axis or rotated about the polishing pad 1 by the rotation of the polishing pad 1 and that of the backing plate 2, whereby the polishing target film 5 on the surface of the wafer 4 is polished by the polishing pad 1.

In this embodiment, the thick portion of the polishing target film 5 is polished while the back surface of the wafer 4 is supported by the high portion of the adjusting section 6. The thin portion of the polishing target film 5 is polished while the back surface thereof is supported by the low portion of the adjusting section 6. This allows the thick portion of the polishing target film 5 to be polished preferentially over the thin portion thereof, so that the thickness of the polishing target film 5 becomes uniform throughout the wafer 4.

In this embodiment, even if thick and thin portions appear in the circumferential direction of the wafer 4, the film 5 can be polished to have a uniform thickness throughout the wafer by forming the adjusting section 6 provided with high and low regions as shown in FIG. 2. According to this embodiment, therefore, the polishing target film, which cannot be planarized by the conventional CMP apparatus in a case shown in FIG. 3, can be planarized to thereby make the film thickness uniform throughout the wafer with high accuracy.

Furthermore, as shown in FIG. 2, even if the CMP apparatus including the backing plate 2 and having a peculiarity in polishing, the peculiarity, i.e., regions in the wafer which are polished easily by the polishing apparatus and those in the wafer which are polished less easily are taken into consideration and the heights of the adjusting section 6 are adjusted so that regions in the section 6 corresponding to the former regions are high and those corresponding to the latter regions are low. This makes it possible to eliminate the polishing peculiarity of the polishing apparatus and to planarize the surface of the polishing target film 5 throughout the wafer 4.

It is noted that the present invention should not be limited to the above-stated embodiment. Namely, in the above-stated embodiment, the contact pressure adjusting section 6 having an irregular pattern is formed on the surface of the stainless steel backing plate 2 by grinding the surface of the plate 2. It is also possible to form an irregular form on the surface by processing a resin member or the like which is easy to process, and to bond and fix the resultant resin member to the backing plate 2.

Figure 6:
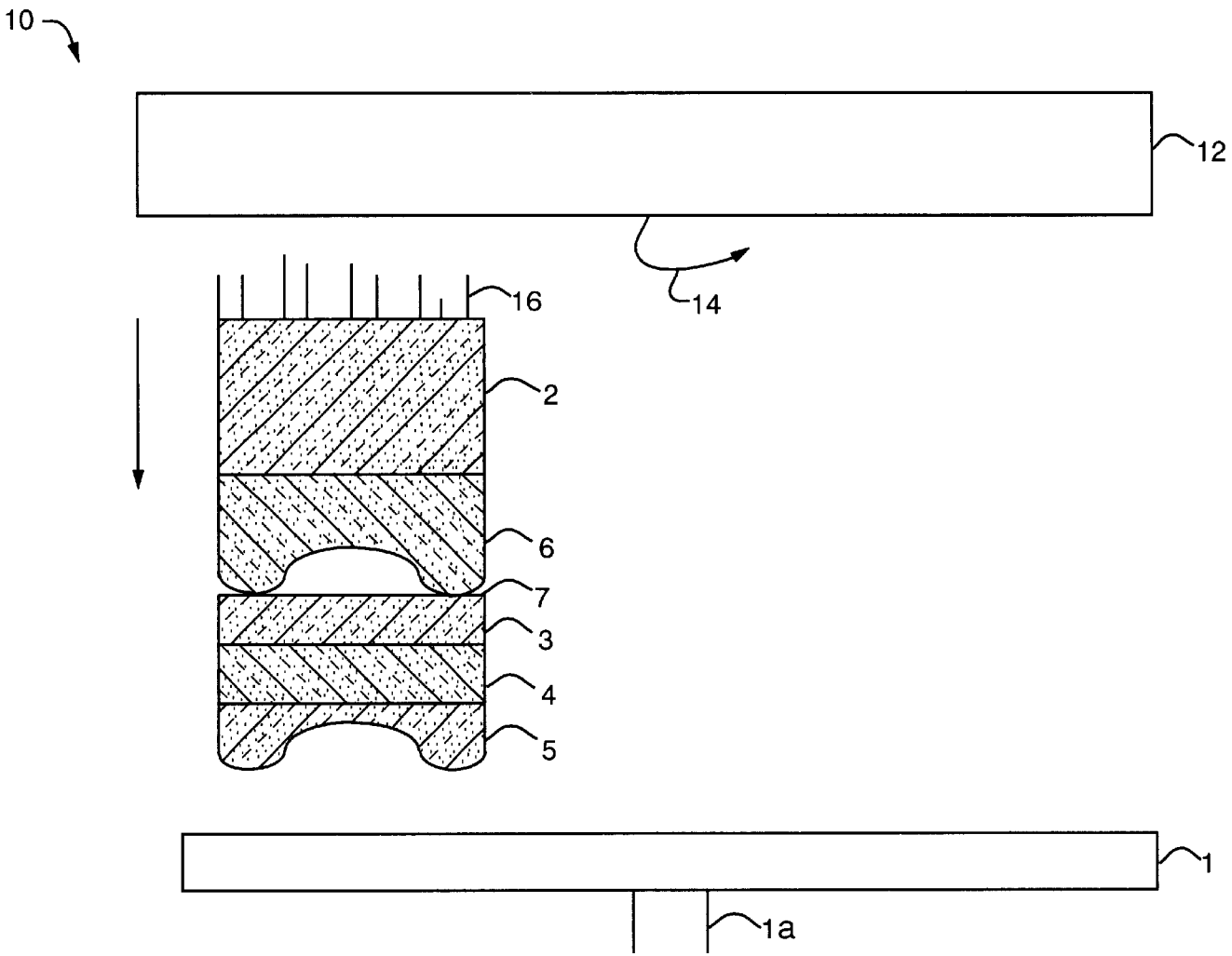

In addition, according to the present invention, if the polishing target film is polished by the friction of the polishing pad, the polishing degree (polishing magnitude) is adjusted by adjusting pressure to be applied when the polishing target film is contacted with the polishing pad and the uneven surface of the film is planarized throughout the wafer. According to the present invention, therefore, it suffices that pressure applied when the back surface of the wafer is pressed against the polishing pad can be adjusted for each region. For example, as with reference to FIG. 6, a plurality of pins 16 which protrude from the backing plate serving as a wafer carrier to the wafer supporting surface thereof may be provided and the heights of the pins may be adjusted by pin height adjusting means. As a result, the back surface of the wafer is pressed by the pins, so that pressure for pressing the polishing target film on the surface of the wafer against the polishing pad can be adjusted and the film can be planarized. It should be noted that also included in the example of FIG. 6 is a pressing unit 12, and other elements as described elsewhere herein in connection with other Figures. The pressing unit 12 may be used to exert a downward force as indicated by the downward arrow for pressing the wafer against the polishing pad 1 through the carrier.

moreover, instead of the adjusting section 6 having an irregular pattern on its surface as shown in FIG. 2, an adjusting section 6 which locally differs in hardness and which have a two-dimensional distribution of hardness can be prepared and used as such. In that case, the two-dimensional distribution of the hardness is formed in the adjusting section 6 so the hardness of the region of the adjusting section corresponding to the thick region of the polishing target film 5 on the surface of the wafer increases and that the hardness of the region of the adjusting section 6 corresponding to the thin region of the film 5 decreases. By doing so, the region of the polishing target film 5 supported by the hard region of the adjusting section 6 is polished easily and that supported by the less hard region of the section 6 is polished less easily. Therefore, the polishing target film 5 can be planarized throughout the wafer as in the case of the embodiment shown in FIG 2.

As stated so far, according to the present invention, since the target film can be planarized throughout the wafer, erosion and recess which indicate depression amount at the time of forming, for example, a damascene wiring can be reduced and the irregularity of these values can be reduced.

The above-stated embodiment concerns a case where the thickness of the polishing target film is made uniform by polishing the film and planarizing the polished surface. Needless to say, the thickness of the polishing target film is not made uniform if the base film of the polishing target film has irregularity. According to the present invention, the difference in the height of the surface (polished surface) of the polishing target film is eliminated to thereby planarize the polished surface. Although the thickness of the polishing target film is eventually made uniform, this is not the very object of the present invention.

As stated so far, according to the present invention, polishing pressure applied when the polishing target film is contacted with the polishing pad increases and so does polishing speed for high regions of the polished surface of the film or regions of the polished surface which are difficult to polish due to the peculiarity of a polishing apparatus. Hence, the present invention can greatly contribute to the improvement of a semiconductor device manufacturing technique, e.g., it can avoid the problem of the erosion and recess of a damascene wiring or the like, by planarizing the polished surface.

What is claimed is:

1. A chemical mechanical polishing apparatus comprising:

a polishing pad;

a carrier comprising a single solid backing plate with a front surface having a predetermined shape and a flexible carrier film for directly contacting and supporting a wafer on which a polishing target film is formed, said front surface of said carrier having at least a high region corresponding to a high region of said polishing target film and having at least a low region corresponding to a low region of said polishing target film; and a pressing unit for pressing said wafer against said polishing pad through said carrier, wherein contact pressure for contacting said polishing target film on said wafer with said polishing pad is adjusted according to heights of at least one of said high region and said low region of said polishing target film.

2. A chemical mechanical polishing apparatus comprising:

a polishing pad;

a carrier supporting a wafer on which a polishing target film is formed;

a pressing unit for pressing said wafer against said polishing pad through said carrier; and a carrier film provided on a surface of said carrier disposed between said carrier and said wafer, said film having a thick region corresponding to a high region of the polishing target film and having a thin region corresponding to a low region of the polishing target film, wherein contact pressure for contacting said polishing target film on said wafer with said polishing pad is adjusted according to heights of at least one of said high region and said low region of said polishing target film.

3. A chemical mechanical polishing apparatus comprising:

a polishing pad;

a carrier having a flexible carrier film disposed on a front surface of the carrier and contacting and supporting a wafer on which a polishing target film is formed; and a pressing unit for pressing said wafer against said polishing pad through said carrier; and the film provided on the front surface of said carrier having a hard region corresponding to a high region of the polishing target film and having a soft region corresponding to a low region of the polishing target film, wherein contact pressure for contacting said polishing target film on said wafer with said polishing pad is adjusted according to heights of at least one of said high region and said low region.

4. A chemical mechanical polishing apparatus comprising:

a polishing pad;

a carrier having a solid front surface in contact with a flexible carrier film that is in contact with and supporting a wafer on which a polishing target film is formed;

a pressing unit for pressing said wafer against said polishing pad through said carrier;

a plurality of pins protruding from a wafer support surface of the carrier; and wherein contact pressure for contacting a surface of said polishing target film on said wafer with said polishing pad is adjusted according to varying thicknesses of said polishing target film.

5. A chemical mechanical polishing apparatus according to claim 1, wherein a thickness at a first point of the surface of said carrier is 100 to 500 times as large as a thickness at a second point of said polishing target film.

6. A chemical mechanical polishing apparatus comprising:

a polishing pad;

a carrier comprising a single solid backing plate with a front surface having a predetermined shape and a flexible carrier film for directly contacting and supporting a wafer as a polishing target having a polishing target film formed thereon, said front surface of said carrier having a high region corresponding to an easily polished region of the polishing target film and having a low region corresponding to a region of the polishing target film polished less easily; and a pressing unit for pressing said wafer against said polishing pad through said carrier, wherein contact pressure for contacting the polishing target film on said wafer with said polishing pad is adjusted in accordance with a degree of ease in polishing a region of said polishing target film based on a relationship between said carrier and said polishing pad.

7. A chemical mechanical polishing apparatus comprising:

a polishing pad;

a carrier supporting a wafer as a polishing target; and a pressing unit for pressing said wafer against said polishing pad through said carrier; and a carrier film provided on a surface of said carrier disposed between said carrier and said wafer with the film having a thick region corresponding to an easily polished region of said polishing target and a thin region corresponding to a region of said polishing target that is polished less easily, wherein contact pressure for contacting a surface of said wafer with said polishing pad is adjusted in accordance with an ease in which a region of said wafer as a polishing target is polished based on a relationship between said carrier and said polishing pad.

8. A chemical polishing apparatus comprising:

a polishing pad;

a carrier supporting a wafer as a polishing target;

a pressing unit for pressing said wader against said polishing pad through said carrier; and a carrier film provided on a surface of said carrier disposed between said carrier and said wafer with the film having a hard region corresponding to an easily polished region of said polishing target and a soft region corresponding to a region polished less easily of the polishing target, wherein contact pressure for contacting a surface of a polishing target film on said wafer with said polishing pad is adjusted in accordance with an ease in which a region of said surface is polished based on a relationship between said carrier and said polishing pad.

9. A chemical mechanical polishing apparatus comprising:

a polishing pad;

a carrier having a solid front surface in contact with a flexible carrier film that is in contact with and supporting a wafer as a polishing target;

a pressing unit for pressing said wafer against said polishing pad through said carrier;

a plurality of pins protruding from a wafer support surface of the carrier; and wherein contact pressure for contacting a polished surface of a polishing target film on said wafer with said polishing pad is adjusted in accordance with ease of polishing a region of said polished surface based on a relationship between said carrier and said polishing pad.

10. A chemical mechanical polishing apparatus according to claim 1, wherein said carrier is a stainless steel backing plate.

11. A chemical mechanical polishing apparatus according to claim 2, wherein said carrier is a stainless steel backing plate.

12. A chemical mechanical polishing apparatus according to claim 3, wherein said carrier is a stainless steel backing plate.

13. A chemical mechanical polishing apparatus according to claim 4, wherein said carrier is a stainless steel backing plate.

14. A chemical mechanical polishing apparatus according to claim 5, wherein said carrier is stainless steel backing plate.

15. A chemical mechanical polishing apparatus according to claim 6, wherein said carrier is a stainless steel backing plate.

16. A chemical mechanical polishing apparatus according to claim 7, wherein said carrier is a stainless steel backing plate.

17. A chemical mechanical polishing apparatus according to claim 8, wherein said carrier is a stainless steel backing plate.

18. A chemical mechanical polishing apparatus according to claim 9, wherein said carrier is a stainless steel backing plate.

19. A chemical mechanical polishing method comprising:

pressing a wafer as a polishing target against a polishing pad while said wafer is supported by a carrier comprising a solid backing plate having a predetermined shape and a flexible carrier film disposed in direct contact with the wafer and the backing plate;

rotating said polishing pad to rotate said wafer about a center of the polishing pad and to cause said wafer to rotate on its own central axis; and adjusting contact pressure for contacting a surface of said wafer with said polishing pad in accordance with thicknesses of a surface of said wafer.

20. A chemical mechanical polishing method comprising:

pressing a wafer as a polishing target against a polishing pad while said wafer is supported by a carrier comprising a solid backing plate having a predetermined shape and a flexible carrier film disposed in direct contact with the wafer and the backing plate;

rotating said polishing pad to rotate said wafer about a center of the polishing pad and to cause said wafer to rotate on its own central axis; and adjusting contact pressure for contacting a polished surface of a polishing target film on the wafer with said polishing pad in accordance with ease of polishing a region of said polished surface based on a relationship between said carrier and said polishing pad.

* * * * *